US010034587B1

(12) United States Patent
Elliot

(10) Patent No.: US 10,034,587 B1
(45) Date of Patent: Jul. 31, 2018

(54) POLE CADDY FOR SHOWER USE

(71) Applicant: Kenney Manufacturing Company, Warwick, RI (US)

(72) Inventor: Timothy Elliot, Attleboro, MA (US)

(73) Assignee: Kenney Manufacturing Company, Warwick, RI (US)

( * ) Notice: Subject to any disclaimer, the term of this patent is extended or adjusted under 35 U.S.C. 154(b) by 0 days.

(21) Appl. No.: 15/612,598

(22) Filed: Jun. 2, 2017

(51) Int. Cl.
*A47K 17/00* (2006.01)
*A47K 3/28* (2006.01)
*A47B 57/56* (2006.01)
*A47B 55/02* (2006.01)

(52) U.S. Cl.
CPC ..... *A47K 17/00* (2013.01); *A47B 55/02* (2013.01); *A47B 57/567* (2013.01); *A47K 3/281* (2013.01)

(58) Field of Classification Search
CPC ..... A47K 17/00; A47K 3/281; A47F 5/0087; A47F 5/08; A47F 5/108; F16L 37/105; Y10T 29/49826; A61G 12/001; A47B 55/02; A47B 57/567; A47B 47/0083; A47B 88/906; A47B 88/497; A47B 87/008; A47B 57/48; A47B 88/60; F16B 7/105
See application file for complete search history.

(56) References Cited

U.S. PATENT DOCUMENTS 1,625,935 A * 4/1927 Cox ..... D06F 81/006 211/153
2,977,953 A * 4/1961 Miller ..... A47J 37/0763 126/30
3,983,823 A * 10/1976 McDonnell ..... A47B 57/18 108/107
4,079,678 A * 3/1978 Champagne ..... A47B 57/545 108/106
4,096,951 A * 6/1978 Menssen ..... A47K 1/05 211/190
4,592,286 A * 6/1986 Trubiano ..... A47B 57/545 108/108
4,860,909 A * 8/1989 Leumi ..... B65F 1/12 211/81
5,566,915 A * 10/1996 Hansare ..... F16M 11/00 248/188.8
5,855,286 A * 1/1999 Zaid ..... A47F 5/04 211/14
D417,991 S 12/1999 Hofman et al.
D429,934 S * 8/2000 Hofman ..... D6/525
D569,148 S 5/2008 Yang et al.
7,401,754 B2 * 7/2008 Welch ..... A47B 57/545 108/110
7,565,762 B2 * 7/2009 Lackey ..... F41A 23/06 211/64
D635,807 S 4/2011 Lindo
(Continued)

*Primary Examiner* — Ko H Chan
(74) *Attorney, Agent, or Firm* — Adler Pollock & Sheehan P.C.; Daniel J. Holmander, Esq.

(57) ABSTRACT

A pole caddy comprises a pole, one or more collars to each of which is removably attached a cantilevered shelf preferably made of metal wire. Each collar, preferably made of structural plastic, has a downwardly extending tab that runs along the pole. The tab has a contact portion, preferably an elastomer pad, in contact with the exterior of the pole. The weight of the shelf and any articles on the shelf applies force through a brace part of the shelf, to cause the tab to frictionally engage the pole and thus hold the shelf at a desired elevation.

12 Claims, 6 Drawing Sheets

(56) References Cited

U.S. PATENT DOCUMENTS

| | | | | |
|---|---|---|---|---|
| 8,215,325 | B2 * | 7/2012 | Montanti | A45B 1/00 135/65 |
| 8,627,966 | B2 * | 1/2014 | Jarvis | A47B 55/00 211/187 |
| 8,763,821 | B2 | 7/2014 | Yang et al. | |
| 9,249,818 | B2 * | 2/2016 | Sabounjian | F16B 12/42 |
| 9,357,860 | B1 | 6/2016 | Klowan | |
| 2006/0193141 | A1 * | 8/2006 | Farmer | A47B 57/565 362/382 |
| 2010/0237032 | A1 | 9/2010 | Whitehall et al. | |
| 2011/0271438 | A1 | 11/2011 | Yang et al. | |
| 2012/0217215 | A1 | 8/2012 | Emery | |

* cited by examiner

POLE CADDY FOR SHOWER USE

TECHNICAL FIELD

The present invention relates to pole caddies, namely devices for holding items within a domestic shower enclosure having one or more shelves supported off a vertical pole.

BACKGROUND

A wide variety of shower caddies are known. There are two essential types of shower caddies: hanging caddies and pole caddies. The present application is concerned with the latter. A typical pole caddy comprises one or more shelves which are cantilevered from a single vertical pole which typically is positioned in the corner of a bathtub enclosure. Often, the pole is spring loaded and compressed between the ceiling and a lower surface such as the tub rim. Examples of some pole caddies can be seen in U.S. Patents as follows: Lindo No. D635,807; Hofman et al. No Des. 417,991; Yang et al. 8,763,821; and Yang et al. D569,148.

Shelves of pole caddies most often have a nominally pie shape or triangle shape, with sides running parallel to the walls of a right angle corner. Typically, shelves are cantilevered from a slidable collar which is screwed locked or otherwise fastened to the pole at a chosen elevation.

The typical wire basket type construction of shower caddies makes them difficult to clean, for example, to remove soap and scum. When a shelf can be removed from the pole that makes cleaning easier. A shelf that is permanently attached to a collar can only be removed by taking down the pole and sliding the collar off the end of the pole, which is inconvenient. FIGS. 2 to 4 herein show how a wire shelf may be engaged with a collar so that the shelf is conveniently removable. Such construction may be used with the present invention.

There is a need for a better way of holding a collar in place and enabling convenient change in elevation from time to time. Use of a screw or other fastener to hold a collar in place may necessitate the use of a tool (which can be misplaced). And a screw may mar the pole surface, disrupting surface finish and inducing corrosion or causing unsightly appearance when a collar elevation is changed. Alternatively, having a pole with plurality of vertical holes or depressions which receive a fastener can increase cost and make maintaining cleanliness harder.

An object of the invention is to provide a pole caddy which has shelves that have improved ease of adjustability. A further object is that such a pole caddy has shelves that can be readily removed for cleaning. A still further object is that the pole caddy be economic to manufacture and ship.

SUMMARY

Figure 1:
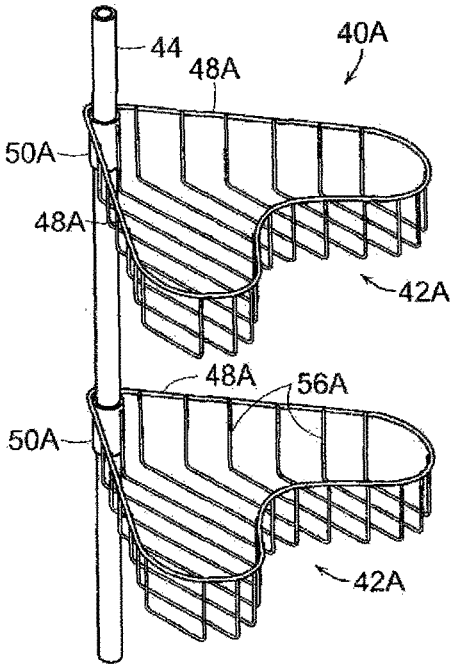
FIG. 1 PRIOR ART
FIG. 1 is a perspective view of a portion of a prior art pole caddy showing shelves which are welded to collars which are clamped to a pole.

An object of the invention is to provide a pole caddy which has shelves that have improved ease of adjustability. A further object is that such a pole caddy has shelves that can be readily removed for cleaning. A still further object is that the pole caddy be economic to manufacture and ship.

In accord with the invention, an embodiment of pole caddy comprises a vertical pole, at least one collar, and at least one shelf removably or permanently attached to the collar. The pole slidably fits within a central hole of the collar and the shelf cantilevers from the collar. Preferably, the shelf is made of welded wire and has tangs that set within holes in the top of the collar body; such attachment permits the shelf to pivot about the collar a in cantilever fashion small amount. A brace helps support the weight of the shelf and any objects carried by the shelf by releasably pressing against a tab which extends downwardly from the body of the collar. The tab has a contact portion, for example an elastomer pad, which is pressed against the pole by the brace due to the weight of the shelf and any load on the shelf, creating frictional force which holds the collar and thus the shelf at a desired elevation. Preferably, the tab has a step on its exterior surface to engage the brace. When a user lifts the shelf manually upward relative to the collar, the frictional force of the tab is relieved and the elevation of the clamp can be adjusted. Typically, there are several such collars and shelves on a single pole.

When the shelf is made of metal wire, the shelf preferably comprises one or more rails which define the periphery of the shelf, which when looked down on has a "pie shape"—characterized by two diverging straight sides and an arcuate outermost rim, suitable for the pole being positioned in a corner. In an embodiment, there is at least a first rail and the brace comprises spaced apart drop-down portions of the first rail and a rest-connector running between the drop-down portions. In a variation, there is a second rail at an elevation higher than the first rail, and the tangs are terminal portions of the ends of the first rail that are nearest the pole.

Preferably, the contact portion of the first tab extends circumferentially from ⅛ to ¼ of the way around the exterior of the pole. Optionally, a collar comprises a second tab that extends upwardly, to add lengthwise stability to the collar. There typically are several like collars and shelves on a pole.

The invention provides a pole caddy which is economical you make and has shelves that are easy to adjust and easy to remove and clean.

DESCRIPTION

The present invention has relation to commonly owned U.S. Pat. No. 9,357,860 of Jeffery Klowan, the disclosure of which is hereby incorporated by reference. In this description a pole caddy, also called a pole caddy assembly, comprises the combination of pole, collar, and shelf. The present invention is described in terms of a preferred pole caddy having shelves made of welded and plated steel wire, alternatively another metal. A collar of the present invention is preferably made of injection molded plastic, more preferably ABS thermoplastic. Alternatively, plastic, metal, and ceramic materials may be used.

For simplicity of illustration, only one exemplary shelf is shown in the Figures other than FIG. 1. As is familiar for prior art pole caddies, a pole caddy assembly of the present invention typically will comprise a multiplicity of shelves, often three or four, all mounted for use on a single pole and each having an associated collar. The several shelves of a pole caddy may be either identical to each other or they may differ in size and shape.

Figure 2:
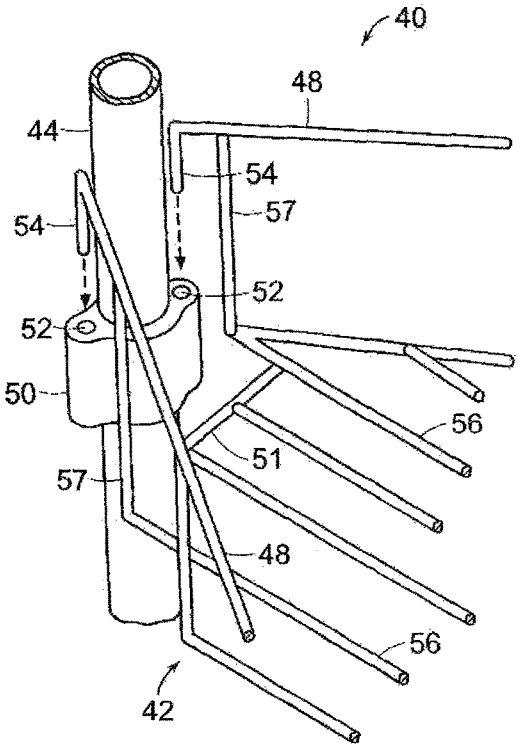
FIG. 2 PRIOR ART
FIG. 2 is a perspective exploded view of a portion of a prior art pole caddy having a shelf with tangs which engage openings in a collar that is clamped to a pole.
Figure 3:
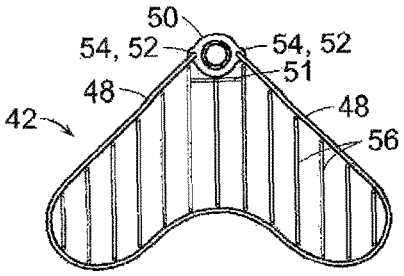
FIG. 3 PRIOR ART
FIG. 3 is a top view of the shelf and pole of the caddy shown in FIG. 2, where the shelf is in its working position.
Figure 4:
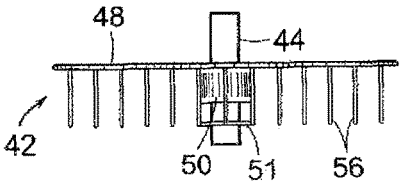
FIG. 4 PRIOR ART
FIG. 4 is a front view of the assembly shown in FIG. 3.

FIGS. 1 to 4 show prior art from the Klowan '860 patent. The Figures both provide background for the present invention and support how certain embodiments of the present invention may be constructed. FIG. 1 shows typical prior art pole caddy 40A which comprises a pole 44 to which are connected two shelves 42A. Each shelf 42A is made of formed and welded wire and includes a top rail 48A and a multiplicity of parallel shallow U shape ribs 56A running in a generally outward direction from the pole location. The top rails and the center rib are permanently attached to collar 50A. For adjustment in elevation of a shelf, the collar may be slid along the length of the pole and locked in position by a screw or the like, not shown Pole caddy 40 of FIGS. 2 to 4 has similar (and related-number) elements to pole caddy 40A. FIG. 2 is a close up exploded view of an exemplary combination of pole 44, collar 50, and shelf 42. Collar 50 may be fastened to the pole to prevent vertical movement in fashion similar to that used with collars in the prior art; for instance, by a screw, not shown. FIG. 3 is a top view and FIG. 4 is a front view of the FIG. 2 assembly. Shelf 42 is engageable and disengageable from the collar by moving the shelf vertically relative to the collar to disengage the tangs 54 which connect the shelf to the collar.

As seen in FIG. 2, exemplary shelf 42 has spaced apart tangs 54 which slide into opposing-side vertical holes 52 of collar 50. The shelf optionally has vertical ends 57 of ribs 56 that are close to the center of the shelf and the ribs desirably bear against the front surface of the collar, to share with the tangs the cantilever bending load of the shelf. Preferably, a portion of the bottom of the shelf, in particular horizontal brace bar 51, bears against the front face of the pole or the collar, depending on the vertical dimensions of the collar and shelf. That provides support for the cantilever load of the shelf and its contents. Preferred collar 50 has two opposing side vertically running holes 52. Alternatively, each hole may have a lengthwise opening running parallel to the pole thereby making the holes into opposing side slots in the collar. In another alternative, the collar may have opposing side vertically-running wings each of which is in effect clamp-gripped between a tang 54 and a shelf portion 57. See the Klowan '860 patent.

Figure 5:
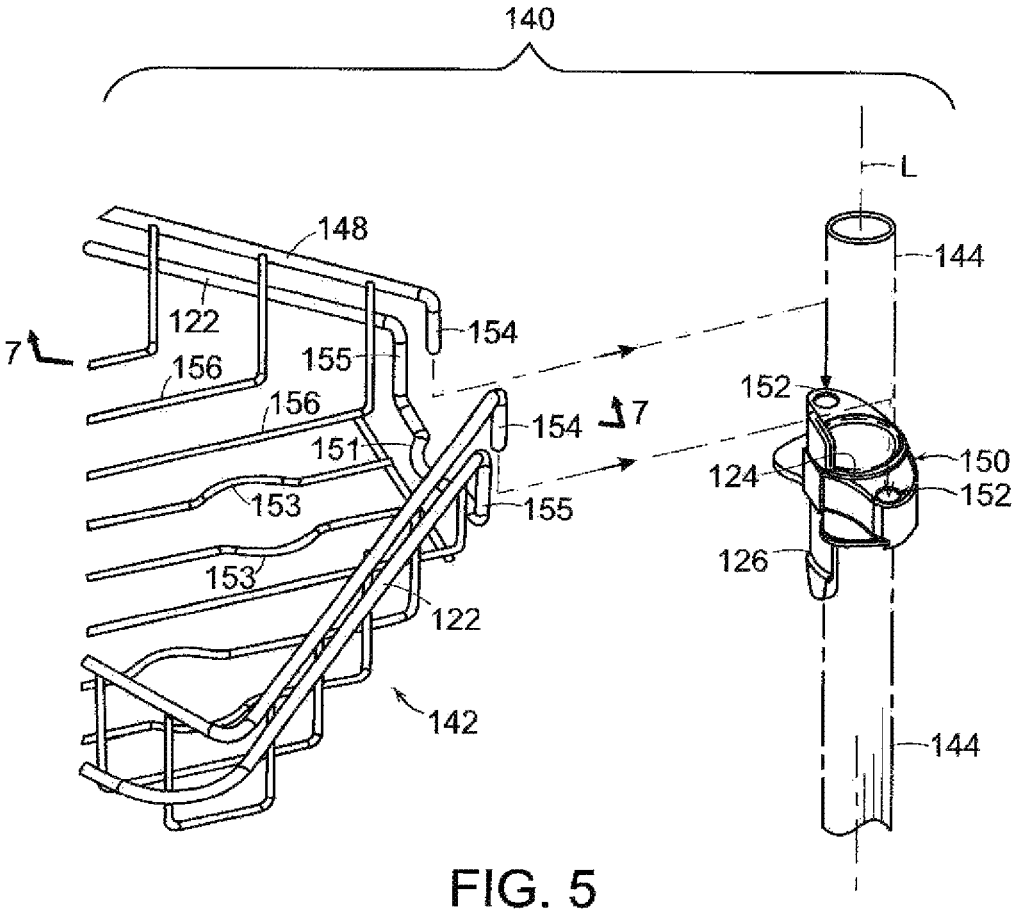
FIG. 5 is an exploded view of a pole caddy assembly of the present invention with a portion of the shelf cut away and the pole shown in phantom.
Figure 6:
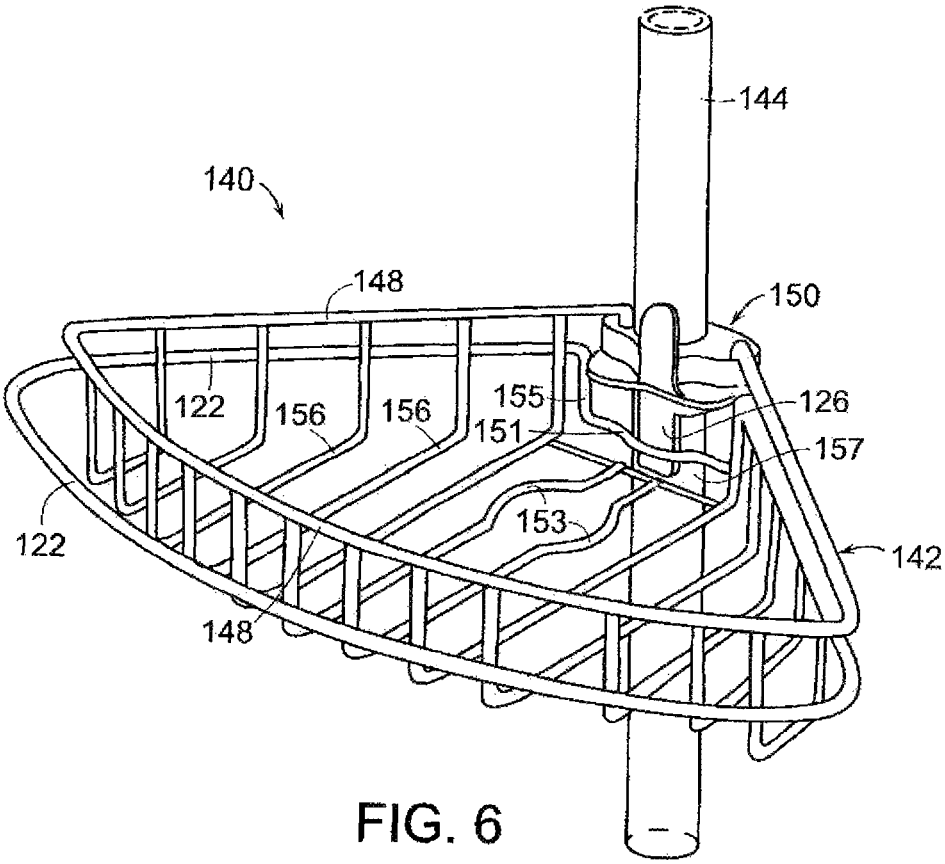
FIG. 6 is a perspective view of the pole caddy assembly shown in FIG. 5.
Figure 8:
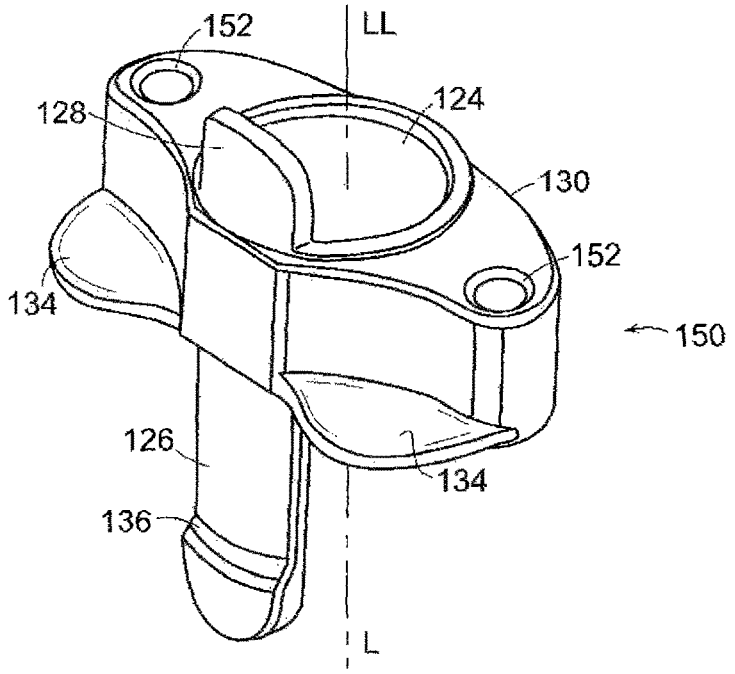
FIG. 8 is a perspective view of a collar for a pole caddy showing the collar front.

FIG. 5 is an exploded view, and FIG. 6 is an assembled view, of an embodiment of pole assembly 140 of the present invention. FIG. 8 shows an exemplary collar by itself. The assembly 140 comprises pole 144 (shown in phantom in FIG. 5), shelf 142, and collar 150. Shelf 142 has tangs 154 that slip into holes 152 of collar 150. The central hole 124 of collar 150 fits around pole 144 in a way which enables the collar to be moved vertically when desired. The central axis L of pole 144 and the central axis LL of collar 142 coincide within the assembly.

Shelf 142 has a construction much like that of shelf 42. The shelf has two diverging sides that run out nominally radially from the pole. Upper rail 148 defines the outer bound of the essential shelf which has the shape of a "piece of pie" when looking down. Shelf 142 comprises U shape ribs 156, the lengths of which run outwardly from the collar location. As best seen in FIG. 5, some of the ribs 156 have optional crooks 153, enabling the bottom of a shelf to receive the stem or handle of an object, such as a brush, or certain containers.

Figure 7:
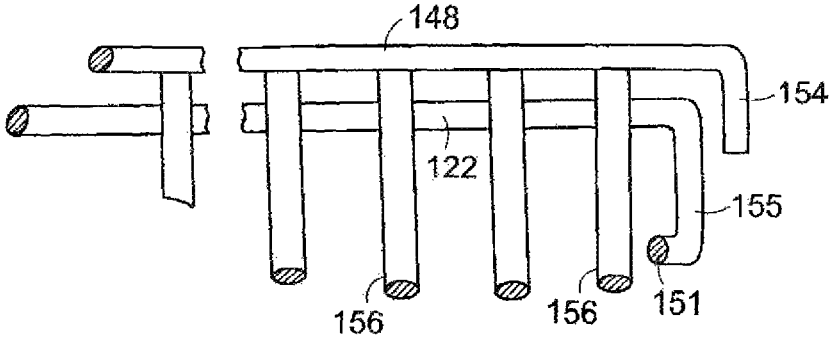
FIG. 7 is a fragmentary side elevation view of a shelf of the pole caddy in FIGS. 5 and 6.

With reference particularly to FIG. 5 to FIG. 7, exemplary shelf 142 has in addition a second rail 122. Along the sides of the shelf, rail 122 is welded to the vertical portions of ribs 156, thus making rail 122 integral with rail 148 at those locations. Arcuate shape rails connect the outer ends of the sides. In that arc-curved portion of the shelf, rail 122 is spaced apart from rail 148 and not attached to ribs 156, thus enabling a cloth or other object to be draped over rail 122.

Near the collar and pole, rail 122 transitions to spaced part drop-down portions 155, which run vertically down to horizontal rest 151. The combination of drop-down portions 155 and the connecting rest 151 comprise brace 157 which contacts a lower portion of the collar. In the generality of the invention, braces for shelves which are made of wire may be constructed differently. In combination with the tangs 154, brace 157 provides support to hold the shelf in its horizontal cantilever orientation. And as discussed below the force of the brace against the collar has utility in keeping the collar at a desired elevation.

Figure 9:
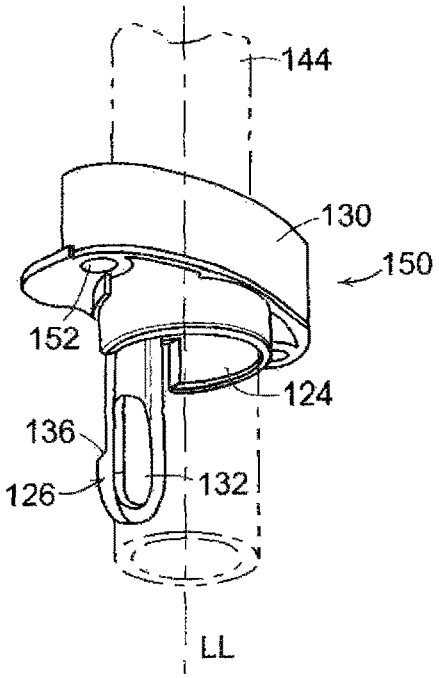
FIG. 9 is a perspective view of the collar of FIG. 8, showing the underside and rear side the collar along a pole in phantom.
Figure 10:
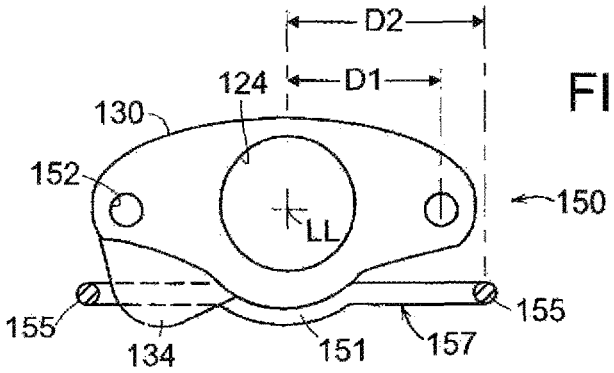
FIG. 10 is a top view of a collar with a small portion of shelf.

With reference particularly to FIGS. 8 to 10, collar 150 comprises a body 130 which has a round central hole 124, shaped to slidably fit around the exterior surface of a pole 144. Hole 124 has a central longitudinal axis LL which can be treated as the length axis of the collar. The portion of the collar which faces toward the shelf is called here the front of the collar. FIG. 8 shows the front of the collar. Body 130 is generally oblong, having less depth than width, when looked at along the longitudinal axis. There are two cavities or holes 152 in the top of the collar; they are centered on the central hole 124 and are shaped to receive the tangs 154 of the shelf. On either side of the central axis LL and the central hole, collar body 130 comprises opposing side flats 134. Flats 134 are optional thin body parts suited for enabling some users to better grip the collar when adjusting it up or down.

With reference particularly to FIG. 8, the front portion of collar 150 comprises upwardly and downwardly extending tabs. First tab 126, also called the lower tab, extends downwardly from the front of the collar body. Tab 126 preferably has a step 136 in its front-facing surface, i.e., the lower end of the tab projects laterally from the longitudinal axis (i.e., front-wise) more than does the portion of the tab which is nearer to the body. Step 136 enhances the engagement between the shelf brace and the collar when there is downward force on the shelf due to weight of objects carried on the shelf. Optional second tab 128, also called the upper tab, extends upwardly from body 130, to add to lengthwise stable engagement between the pole and collar. The inner-facing surface of each tab (that which faces toward the longitudinal axis LL and pole) is preferably curved to fit the exterior of a pole which slip-fits within hole 124.

When a shelf is positioned at a desired elevation, the tab is releasably pressed against the pole, to hold the collar and shelf at a desired elevation, as follows. With reference to FIG. 9, the inner-facing surface of the lower tab 126 has contact portion 132 that is configured to frictionally well-engage the outer surface of the pole, when sufficient force (e.g., vector M2 in FIG. 12) is applied to the tab, as by brace 157 of shelf 142. Preferably the contact portion 132 comprises a rubber or plastic pad which fits within a shallow cavity on the pole-facing surface of tab 126. The contact portion, i.e., the pad when present, preferably projects radially inwardly a slight amount relative to the bore of hole 124, to ensure that the contact portion, i.e., the pad when present, will be at least engaged with light pressure with an in-place pole under no shelf load. The contact portion is be capable of good frictional engagement with the exterior surface of the pole. Preferably, when the contact portion is a pad, the pad is made of a thermoplastic elastomer (TPE) having a Durometer of Shore A 50-60. Preferably, a pad is fastened to the tab by adhesive or integral molding. Alternatively, it is mechanically held in place.

Figure 11:
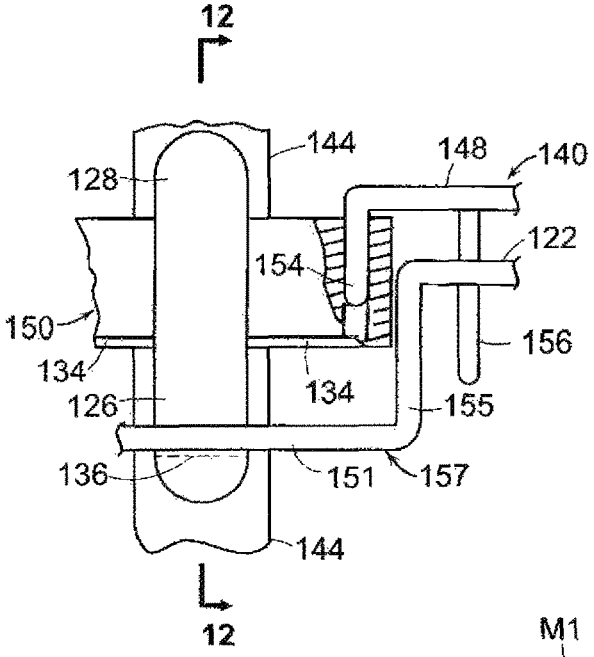
FIG. 11 is a front view of a collar mounted on a pole with a portion of the collar cut away, along with a portion of shelf.
Figure 12:
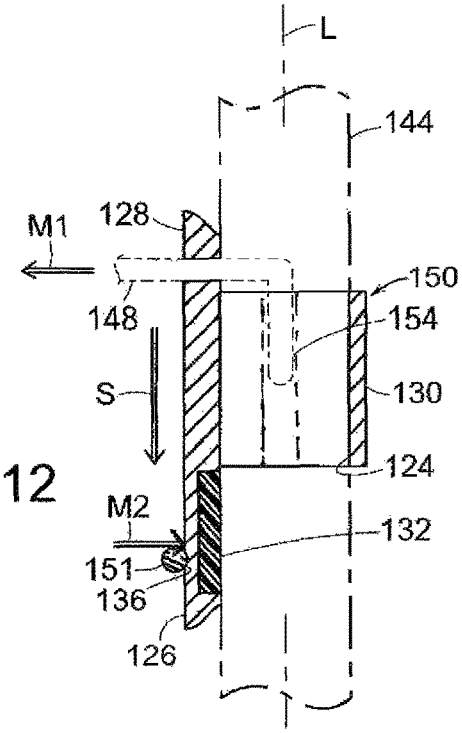
FIG. 12 is a vertical cross section of the collar shown in FIG. 11, with the shelf rail parts shown in phantom.

FIG. 10-12 are related but vary in the extent shelf parts are portrayed. FIG. 10 is a top view of a collar 150 along with a portion of the brace 157 of a shelf. FIG. 11 is a front view of a portion of a collar 150 (with a collar portion cut-a-way to show the shelf tang 154) along with portions of shelf 140 and pole 144. FIG. 12 is a vertical cross section of collar 150 mounted on a pole, shown in phantom, along with shelf portions parts 148, 154 and 151.

With reference to FIGS. 10 to 12, with emphasis on FIG. 12, the weight of the shelf itself and any load carried by the shelf must be resisted in two respects by the collar. First, there is a vertical downward shear force represented by vector S. Second, there is a bending moment that is a consequence of the centroid of shear force being at a distance from the pole, i.e., it is nominally at or beyond the midpoint of the shelf cantilever extension. That bending moment is represented in the drawing by a vector couple M1, M2. The tangs 154 at the ends of rails 148 pull away from the pole due to force M1 and rest-connector 151 of brace 157 applies force in the direction of the pole due to force M2.

The force represented by vector S is resisted by the collar top surface support of the rails 148 proximate the tang-ends and by the support of brace 157 on step 136 of tab 126. The collar resists the shear force S due to its friction engagement with the pole, which is produced as a result bending force M2 being applied to the tab of the collar.

Through rest-connector 151 (i.e., brace 157) force M2 applies load in a nominally horizontal direction to the tab 126. The force thus increases frictional engagement of the contact portion 132 and the surface of the pole. Routine engineering may be used in dimensioning a pole caddy assembly as just described; and when that is done the result is that there will be frictional engagement of the collar with the pole due to the weight of an empty shelf, sufficient to hold the collar vertically in position, resisting vertical downward force S on the collar. The more weight of items a user places on the shelf, the more the frictional force between the tab of the collar and the pole is increased, to resist the tendency of the collar to move downward. The smaller the distance between the location where the brace applies force and the attachment of the shelf to the upper end of the collar, the greater will be the force M2 for any given weight or load of a shelf.

From the foregoing, it will be understood that it is desirable that there will be a substantial force (M2) applied to the lower tab by weight of the shelf and any objects carried by it. When a shelf is constructed of about 0.2 inch diameter steel wire with engagement of tangs 154, as previously described, the nature and flexibility of the tangs and contiguous rail portions allows a wire shelf to pivot at least a small amount downwardly and upwardly relative to (the top of) the collar body to enable force M2 to be applied to the tab, as described above. Should a shelf be constructed differently in accord with the invention, the designer will ensure that the attachment of the cantilevered shelf to the collar in proximity to the top of the collar allows the shelf to pivot down (and then up, to release the tab-force) at least a small amount. Thus a brace can apply force to the tab, varying according to the load which is carried by the shelf, compared to having an upper end attachment that is so stiff and inflexible as to not allow the brace to apply load. While the term "pivot" is used herein with respect to the shelf's slight cantilever movement, within that term is comprehended bending, as can be the case where there are tang connections. When there is no load on the shelf, the design is of such a nature that the weight of the shelf applies force to the tab sufficient to keep the unloaded shelf at a fixed elevation. Optionally a preload may be built into the attachment and or tab. Reasonable experiment will enable carrying out the invention.

Should a user of a pole assembly desire to change the elevation of a shelf by moving the collar up or down, the user may apply upward or lifting force to the shelf, to reduce the force S, which thereby also lessens the force M2 applied by the brace. Thus, the frictional engagement of the contact portion 132 with the pole surface will be reduced, preferably to near zero. While doing that, the user grasps the collar, with the convenient option of grasping the flats 134, and slides the collar up or down.

A typical pole will have an about 0.9 inch diameter; the rails (and thus the tangs) of an exemplary steel shelf will have a diameter of about 0.2 inch and the holes in the collar may be about 0.21 inch diameter and spaced apart about 1.9 inch. An exemplary collar made of ABS thermoplastic to fit an about 0.9 inch diameter pole may have an overall width of about 2.3 inch and an overall height of about 2.5 inch; and, a body thickness of about 1 inch. An exemplary contact portion/pad may run around ⅛ to ¼ of the circumference of the pole.

Figure 13:
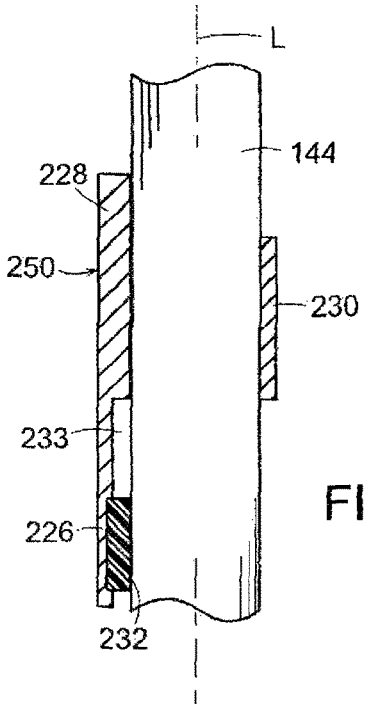
FIG. 13 is a view like FIG. 12, showing an alternative embodiment of collar.

FIG. 13 shows an alternate embodiment of collar 250 mounted on pole 144. The collar has a body 230, an upper tab 228, and a lower tab 226 that has a contact portion 232, preferably an elastomer pad, as pictured. Compared to the lower tab of collar 150 which has along its length an interior surface that closely fits the exterior surface of the pole, the lower tab 226 of collar 250 has a portion which is disposed away from the pole. There is a space 233 between the pad 232 and the collar body 230. FIG. 13 also shows a collar having a lower tab that lacks a step for the brace of the shelf.

Figure 14:
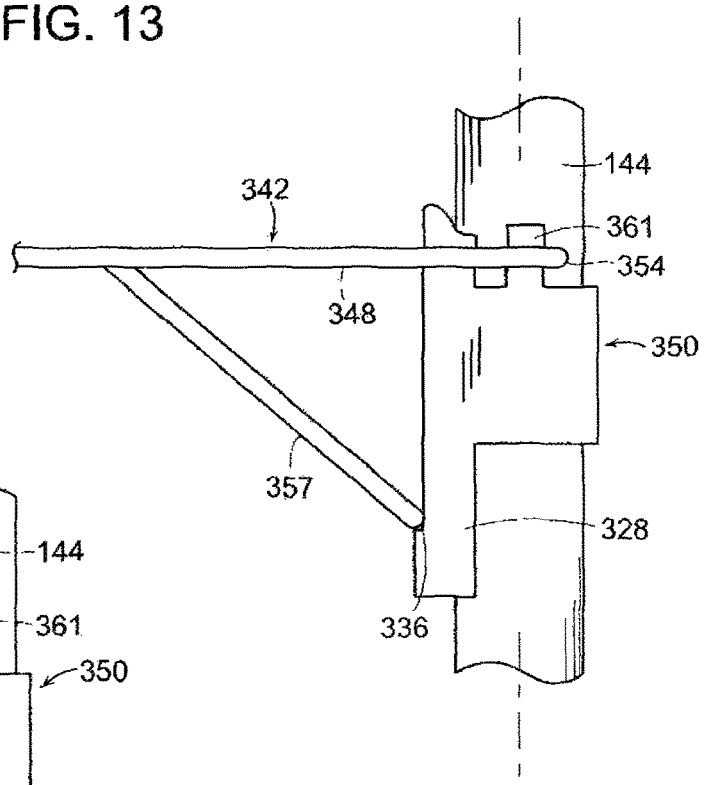
FIG. 14 is a side elevation view of a portion of an alternative design shelf as it held on a pole by a collar.

In the invention, shelves may have other configurations than that of exemplary shelf 142 and different attachment means may be used, some of which were mentioned at the beginning of this description. FIG. 14 shows in side elevation an alternative design shelf 342 as it is being held on a pole 144 by collar 350. Shelf 342 has a flat surface defined by a plurality of horizontally running ribs 348. Two of the ribs 354 have ends shaped as eyes that slip-fit onto upwardly projecting pins 361, to form the attachment means between the shelf and collar. A wire rod or other form of brace 357 extends at an angle downwardly from the plane of the shelf surface and rests on step 336 of the lower tab 328 of the collar.

Figure 15:
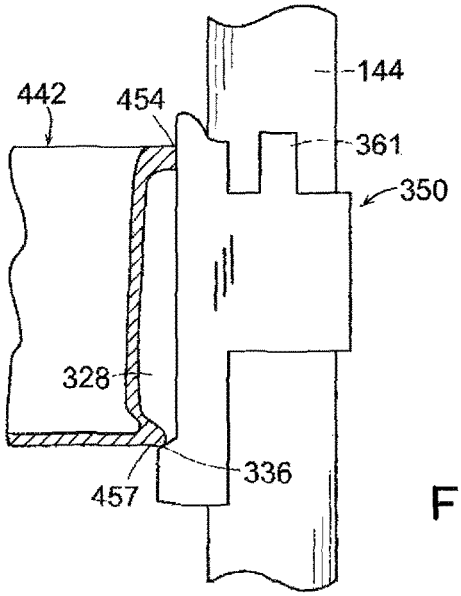
FIG. 15 is a side elevation view of a portion of another alternative design shelf, shaped like a basket, as it is held on a pole by a collar. The shelf only is cross sectioned.

FIG. 15 shows a caddy assembly embodiment employing the same collar 350, where the shelf 442 is in the form of a molded plastic basket having a concavity for holding objects. The top of the shelf 442 comprises two members like the ribs 354 just described where laterally extending portions of the shelf have eye-holes to engage pins 361. (One rib 354 is cut away in FIG. 15, since the shelf 442 only is cross sectioned vertically.) Other attachment means for holding shelf 442 to the collar may be used, such as tangs, clips, clamps, fasteners, etc. The bottom edge 457 of the shelf/basket 442 which is nearest the collar acts as a brace, as it is engaged with step 336 of the lower tab 328. As with other examples presented here, alternative embodiments may comprise a collar which has either or both of an upward extending second tab or no step on the first tab.

It is within contemplation that the present invention may be employed with collars that are permanently attached to the shelf, notwithstanding the disadvantage mentioned in the Background. For example, the shelf might be attached to the collar by being welded or adhesive bonded to the collar; or a collar might be molded as an integral part of a shelf.

As described, the contact portion of a lower tab preferably comprises a pad. Such pad is fabricated as a separate element so it can be made of a material different from that of the body of the collar. Within the generality of the invention the contact portion may be integral with the material of the tab and the body, yet may have different structural behavior. For example, the material of the collar might have sufficient malleability and surface property to provide the desired frictional engagement property with the pole surface for the tab. And such material may have embedded in it plastic or metal reinforcing members at the body portion of the collar, to provide the requisite structural properties for that element.

In the generality of the invention, pole cross sections other than round may be used. For example, an oblong or square cross section may be used. And collars having different external configurations than exemplified here may be used. For example, the collar may be rectanguloid.

A pole caddy of the present invention may be shipped in knock down condition, as a kit which is packaged in a carton, for example. The pole may comprise several telescoping segments that may be put together by a user. Several individual collars will be included in the kit, unmounted. Several shelves will be provided, each for attachment to a collar after the user has assembled the pole and put the collars on the pole.

The invention, with explicit and implicit variations and advantages, has been described and illustrated with respect to several embodiments. Those embodiments should be considered illustrative and not restrictive. Any use of words such as "preferred" and variations suggest a feature or combination which is desirable but which is not necessarily mandatory. Thus embodiments lacking any such preferred feature or combination may be within the scope of the claims which follow. Persons skilled in the art may make various changes in form and detail of the invention embodiments which are described, without departing from the spirit and scope of the claimed invention.

I claim:

1. A pole caddy comprising:

a vertical pole having a length, a lengthwise axis, a cross section, and an exterior surface;

at least one collar comprising a body having a central hole sized to slidably fit the exterior surface of the pole, wherein the pole is positioned with the central hole;

said collar having a first tab extending downwardly from the collar body and along the pole length, the first tab having a contact portion for pressing against the exterior surface of the pole;

at least one shelf, removably or permanently attached to the collar body at one or more points so that the shelf is cantilevered from and pivotable up and down at least a small amount about said one or more points of attachment;

said shelf comprising a brace in contact with the collar first tab, for releasably pressing the first tab against the pole exterior surface to cause frictional engagement between the contact portion and the pole exterior surface;

wherein the shelf is held at a fixed elevation along the pole length when the brace applies force to press the first tab against the pole;

wherein the body of the at least one collar has two spaced apart tang holes centered the central hole in the body;

wherein the at least one shelf comprises two spaced apart tangs, each tang positioned within one of said tang holes;

wherein, the tangs are removable from the tang holes by lifting the shelf vertically;

wherein the shelf is made of metal wire and comprises at least one rail; and wherein the brace comprises spaced apart drop-down portions of the least one rail in combination with a connector running between the drop-down portions.

2. The pole caddy assembly of claim 1 wherein the at least one rail has a first elevation, further comprising:

a second rail having a second elevation higher than the first rail elevation;

a plurality of U-shape ribs connecting portions of the first rail and the second rail;

the second rail terminating at two tangs;

wherein the collar body has two tang holes on the top of the body and centered on said central hole; and wherein each tang is positioned within one of said tang holes and is vertically removable therefrom.

3. The pole caddy assembly of claim 2 wherein the at least one rail and the second rail each have an arcuate portion;

Wherein the arcuate portion of the second rail is attached to the plurality of said U-shape ribs, and the arcuate portion of the at least one rail is located further from the pole than is the arcuate portion of the second rail.

4. A pole caddy comprising:

a vertical pole having a length, a lengthwise axis, a cross section, and an exterior surface;

at least one collar comprising a body having a central hole sized to slidably fit the exterior surface of the pole, wherein the pole is positioned with the central hole;

said collar having a first tab extending downwardly from the collar body and along the pole length, the first tab having a contact portion for pressing against the exterior surface of the pole;

at least one shelf, removably or permanently attached to the collar body at one or more points so that the shelf is cantilevered from and pivotable up and down at least a small amount about said one or more points of attachment;

said shelf comprising a brace in contact with the collar first tab, for releasably pressing the first tab against the pole exterior surface to cause frictional engagement between the contact portion and the pole exterior surface;

wherein the shelf is held at a fixed elevation along the pole length when the brace applies force to press the first tab against the pole; and wherein the contact portion of the first tab comprises a pad made of material different from the material of the body of the collar.

5. The pole caddy assembly of claim 4 wherein the collar body is made of plastic and the contact portion of the first tab is made of an elastomer.

6. The pole assembly of claim 4 wherein the pad is made of an elastomer having a Shore A Durometer of 50-60.

7. The pole caddy assembly of claim 1 further comprising one or more collars like the at least one collar mounted on the pole and one or more second shelves, each mounted on one of said second collars.

8. A pole assembly comprising:

a vertical pole having a length, a lengthwise axis, a cross section, and an exterior surface;

at least one collar comprising a body having a central hole sized to slidably fit the exterior surface of the pole, wherein the pole is positioned with the central hole;

said collar having a first tab extending downwardly from the collar body and along the pole length, the first tab having a contact portion for pressing against the exterior surface of the pole;

the body having a top with two spaced apart tang holes centered on the central pole; and at least one shelf, removably attached to the collar body at the top thereof, so that the at least one shelf is cantilevered from and pivotable up and down at least a small amount about said one or more points of attachment;

the at least one shelf comprising a brace in contact with the collar first tab, for releasably pressing the first tab against the pole exterior surface to cause frictional engagement between the contact portion and the pole exterior surface;

wherein the at least one shelf is held at a fixed elevation along the pole length when the brace applies force to press the first tab against the pole;

the at least one shelf made of metal wire and having two spaced apart tangs, wherein each tang is positioned within one of said tang holes to thereby removably connect the shelf to the top of the collar in said cantilever and pivotable fashion, each tang vertically removable from its respective hole.

9. The pole caddy assembly of claim 8 further comprising one or more second collars like the at least one collar mounted on the pole and one or more second shelves, each mounted on one of said second collars.

10. The pole caddy assembly of claim 8 wherein the first tab has front surface facing away from the pole, wherein the front surface has a step near the lower end of the tab and the brace is in contact with the step.

11. The pole caddy assembly of claim 8 wherein the shelf comprises:

a first rail at a first elevation;

a a second rail at a second elevation which is higher than the first elevation; and a plurality of U-shape ribs connecting portions of the first rail and the second rail;

wherein said two tangs are portions of the second rail.

12. The pole caddy assembly of claim 11 wherein the first rail and the second rail each have an arcuate portion;

the arcuate portion of the second rail attached to a plurality of said U-shape ribs, and the arcuate portion of the first rail located further from the pole than the arcuate portion of the second rail.

* * * * *